United States Patent [19]

Poldervaart

[11] Patent Number: 4,836,813

[45] Date of Patent: Jun. 6, 1989

[54] MOORING SYSTEM

[75] Inventor: Leendert Poldervaart, La Turbie, France

[73] Assignee: Single Buoy Moorings Inc., Marly, Switzerland

[21] Appl. No.: 206,348

[22] Filed: Jun. 14, 1988

[30] Foreign Application Priority Data

Jun. 15, 1987 [NL] Netherlands ..... 8701388

[51] Int. Cl.[4] ..... B63B 22/02

[52] U.S. Cl. ..... 441/3; 114/230

[58] Field of Search ..... 441/3, 4, 5; 114/230

[56] References Cited

U.S. PATENT DOCUMENTS 3,668,725 6/1972 Renz et al. ..... 114/230

4,226,204 10/1980 Tuson .

4,309,955 1/1982 Kentosh .

4,351,260 9/1982 Tuson et al. .

FOREIGN PATENT DOCUMENTS 79404 5/1983 European Pat. Off. ..... 114/230

*Primary Examiner*—Sherman D. Basinger

*Assistant Examiner*—Thomas J. Brahan

*Attorney, Agent, or Firm*—Young & Thompson

[57] ABSTRACT

Mooring system comprising a vessel, a chain anchored buoy and a rigid arm between buoy and vessel, which arm is pivotable about a horizontal axis at the vessel and has a weight loaded extension which hold the arm against a stop but allows rotation of the arm if a certain value of the forces on the anchor chains is reached.

5 Claims, 2 Drawing Sheets

MOORING SYSTEM

The invention relates to a mooring system, comprising a floating device such as a ship, a movable body such as a buoy, which is anchored by means of anchor chains to the water bottom, and which on displacement away from the neutral position can produce an adjusting force which increases with the displacement, and a rigid arm between the floating device and the body, said arm being connected to the floating device by means of a hinge which has a horizontal hinge pin standing at right angles to the longitudinal axis of the floating device.

Such a mooring system is known, for example, from Dutch Patent Application No. 8200358, which has been published.

A ship moored in this way by means of anchor chains is held in place by the forces in the anchor chains. On displacement, these chains are pulled tighter, at least at the side facing away from the direction of displacement. The forces in these chains then increase and thus provide the adjustment.

Anchor chains are, however, also strained by the vertical movements of the ship. When the bow goes down the chains fall, and the tension in these chains also falls. When the bow rises, the chains go up too, and the tension rises. In normal, the chains go up too, and the tension rises. In normal weather conditions this is no problem. In bad weather, in particular in rarely occurring heavy storms, the chains move over great distances. If there is a vertical movement of the bow of, say, 20 metres, this means that the maximum displacement of the chains can be as much as twice that figure, measured between the lowest position at which the chains hang slack and the taut position. Here, within a short space of time of, say, 15 to 20 seconds, very great forces occur in the chains, and they can be greater than the forces occurring when a chain is pulled taut.

The forces concerned here are the dynamic forces occurring in the chains, such as the forces on chains occurring on acceleration, which not only have mass, but also experience resistance against movement in the water.

The object of the invention then is to find a solution for this, and this object is achieved according to the invention in that the arm is integral with a lever which is located at the sides of the horizontal hinge facing away from the anchor chains, and which is held by a downward-directed force against a stop, said force being of such magnitude that it holds said lever firmly against the stop so long as the forces occurring in the anchor chains as a result of the vertical movements of the ship do not exceed a certain value.

As soon as circumstances which could bring about these extra heavy stresses on the chains occur, the force which held the lever, and thus the arm, fast is overcome. The arm can now pivot, with the result that the forces occurring in the chains are related to the force acting on the lever. This force thus limits the tensions which can occur in the chains.

One of the consequences of this is that lighter chains can be used.

It is pointed out that a mooring device having a rigid arm on the bow of the ship coupled via a turntable to anchor chains is known per se, for example from European Patent Specification No. 0,059,499. However, the problem on which the invention is based is encountered to an even greater degree here.

The force is preferably supplied by a weight on the lever, in particular a weight at the site of the stop.

The force can, however, be supplied in another way, and the stop can also be located in a position other than the place where the force acts.

According to a further development of the invention, the force can be removable, for example by using a removable weight, or by making the weight consist of water ballast. At the point where the weight is, there is a tank full of water and provided with means for draining or filling the tank.

If the force is lifted, then the coupling to a buoy floating on the water is very simple to achieve.

The invention will now be explained in greater detail with reference to the drawings.

Figure 1:
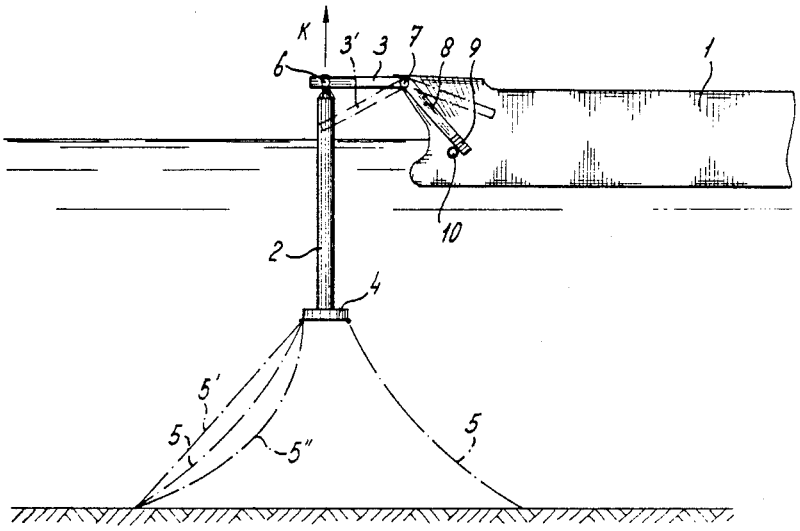
FIG. 1 shows schematically in side view a first embodiment of the mooring system according to the invention.

FIG. 1 shows a floating device in the form of a tanker 1, which together with the buoy 2, designed as a column, and the connecting arm 3 forms the mooring system. At the bottom end the buoy 2 has a ring 4 with chain stoppers for anchor chains 5 running to anchors which engage in the seabed. A universal joint 6 is provided between the top end of the buoy 2 and the arm 3. The arm 3 is connected to the tanker 1 by means of a horizontal hinge 7.

The arm 3 now has according to the invention an extension 8 containing a weight 9.

The body of the tanker is provided at 10 with a stop which can be coated with elastic material.

In the initial position shown, the extension 8 of the arm is resting with the weight 9 on the stop 10.

If there is a displacement in the upward direction, such as that indicated by the arrow K, which may or may not be accompanied by a displacement to the right in FIG. 1, then the anchor chains 5 will be pulled tauter, as indicated by the line 5'. If there is a displacement downwards, then the chains fall to the position shown by 5''.

During normal wave movements the chains are capable of following these movements, and the arm 3 with extension 8 behaves like a rigid arm, due to the fact that the extension 8 is held by the weight 9 against the stop 10.

If, however, a predetermined limit value is exceeded, for example if very high waves occur due to a heavy storm, then the force supplied by the weight 9 will be overcome and the arm tilts to the position shown schematically by 3', in which case the tension in the anchor chains 5 depends on the couple which is exerted by the weight 9 over the hinge 7.

Figure 2:
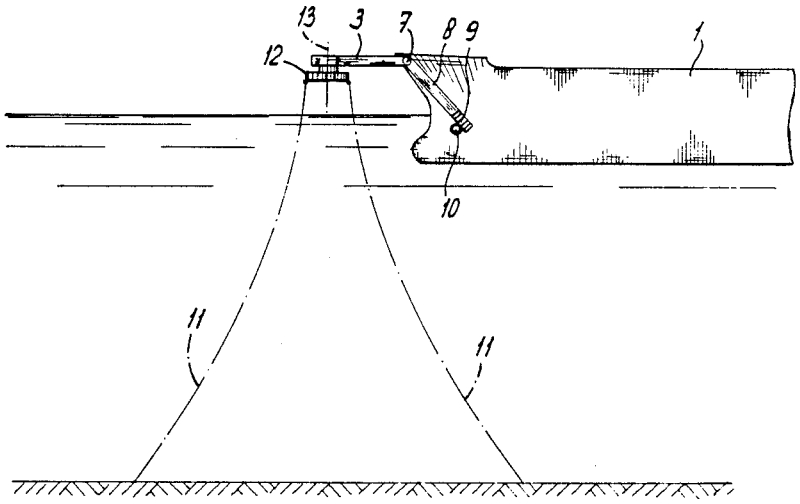
FIG. 2 shows schematically in side view a second embodiment.

The embodiment of FIG. 2 differs from that of FIG. 1 only in that the anchoring is formed solely by anchor chains 11 suspended from a turntable 12, which is fixed to the arm 3 in such a way that it rotates about a vertical shaft 13 and may be disconnected if desired, said arm in turn pivoting about the hinge 7 and having an extension 8 with the weight 9 which rests on the stop 10. In this embodiment also the arm behaves like a rigid arm until the tension in the anchor chain 11 has reached a value which causes the arm to start pivoting about the hinge 7.

Figure 3:
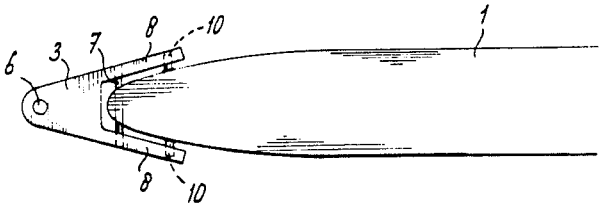
FIG. 3 is a top view of FIG. 2.

The top view shown in FIG. 3 serves merely to indicate that the arm 3 can be designed as a fork with the extensions 8 directed backwards past the hinge 7 being on either side of the bow of the ship, and with the stops 10 on either side of the bow by means of a horizontal hinge 7.

The body of the tanker is provided at 10 with a stop which can be coated with elastic material.

In the initial position shown, the extension 8 of the arm is resting with the weights 9 on the stop 10.

The weight 9 can consist of a tank full of water.

When this tank is drained, the arm swings down and permits coupling with a floating body 2 or 12.

I claim:

1. Mooring system, comprising a floating device such as a ship an anchor line support structure which is anchored by means of anchor chains to the water bottom, and which on displacement away from the neutral position can produce an adjusting force which increases with the displacement, and a rigid arm between the floating device and said structure, said arm being connected to the floating device by means of a hinge which has a horizontal hinge pin standing at right angles to the longitudinal axis of the floating device, wherein the arm is integral with a lever which is located at the sides of the horizontal hinge facing away from the anchor chains, and which is held by a downward-directed force against a stop, said force being of such magnitude that it holds said lever firmly against the stop so long as the forces occurring in the anchor chains as a result of the vertical movements of the floating device do not exceed a certain value.

2. Mooring system according to claim 1, wherein the force is supplied by a weight on the lever.

3. Mooring system according to claim 2, wherein the weight is removable.

4. Mooring system according to claim 3, wherein the weight is formed by water ballast.

5. Mooring system according to claim 1, wherein the force can be lifted.

* * * * *